US010493774B2

(12) United States Patent
Kanno et al.

(10) Patent No.: US 10,493,774 B2
(45) Date of Patent: Dec. 3, 2019

(54) ELEMENT SUBSTRATE, MANUFACTURING METHOD THEREOF, PRINTHEAD, AND PRINTING APPARATUS

(71) Applicant: CANON KABUSHIKI KAISHA, Tokyo (JP)

(72) Inventors: Hideo Kanno, Yokohama (JP); Nobuyuki Hirayama, Fujisawa (JP); Sadayoshi Sakuma, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/150,373

(22) Filed: Oct. 3, 2018

(65) Prior Publication Data

US 2019/0105921 A1 Apr. 11, 2019

(30) Foreign Application Priority Data

Oct. 11, 2017 (JP) ..... 2017-197771
Aug. 29, 2018 (JP) ..... 2018-160602

(51) Int. Cl.
*B41J 2/045* (2006.01)
*B41J 2/14* (2006.01)
(Continued)

(52) U.S. Cl.
CPC ..... *B41J 2/33535* (2013.01); *B41J 2/04563* (2013.01); *B41J 2/14072* (2013.01);
(Continued)

(58) Field of Classification Search
CPC ..... B41J 2/04563; B41J 2/14072; B41J 2/14129; B41J 2/14153; B41J 2/1603;
(Continued)

(56) References Cited

U.S. PATENT DOCUMENTS 5,841,448 A * 11/1998 Moriyama ..... B41J 2/04563 347/19
6,685,304 B2 * 2/2004 Miyamoto ..... B41J 2/14129 29/611
(Continued)

FOREIGN PATENT DOCUMENTS

EP 0887186 A1 12/1998
EP 1205303 A1 5/2002
(Continued)

OTHER PUBLICATIONS

Extended European Search Report dated Feb. 22, 2019, in counterpart application EP 18195040.3 (11 pages).
Pending U.S. Appl. No. 16/019,714, filed Jun. 27, 2018.

*Primary Examiner* — Anh T Vo
(74) *Attorney, Agent, or Firm* — Venable LLP

(57) ABSTRACT

On an element substrate having a multilayered structure in which a temperature detection element is provided in an intermediate layer of a wiring layer and a print element layer, a wiring layer and a temperature detection element formed on the first interlayer insulation film are connected by a first conductive plug which penetrates through the first interlayer insulation film. In addition, a wiring layer and a print element which are formed on the second interlayer insulation film formed on the first interlayer insulation film are connected by a second conductive plug which penetrates through the first and second interlayer insulation films. By manufacturing the element substrate by this arrangement, the thickness of an interlayer insulation film between a print element and a temperature detection element can be made thin, and the sensitivity of the temperature detection element can be improved.

23 Claims, 9 Drawing Sheets

(51) Int. Cl.
*B41J 2/335* (2006.01)
*B41J 2/16* (2006.01)

(52) U.S. Cl.
CPC ..... *B41J 2/14129* (2013.01); *B41J 2/14153* (2013.01); *B41J 2/1603* (2013.01); *B41J 2/1628* (2013.01); *B41J 2/1631* (2013.01); *B41J 2/1632* (2013.01); *B41J 2/1642* (2013.01); *B41J 2/1645* (2013.01); *B41J 2/1646* (2013.01); *B41J 2/3353* (2013.01); *B41J 2/3359* (2013.01); *B41J 2/33595* (2013.01); *B41J 2202/18* (2013.01)

(58) Field of Classification Search
CPC ..... B41J 2/1628; B41J 2/1631; B41J 2/1632; B41J 2/1642; B41J 2/1645; B41J 2/1646; B41J 2/3353; B41J 2/33535; B41J 2/3359; B41J 2/33595; B41J 2202/18
See application file for complete search history.

(56) References Cited

U.S. PATENT DOCUMENTS

| | | | | |
|---|---|---|---|---|
| 9,033,442 | B2 | 5/2015 | Kanno et al. | |
| 10,035,346 | B2 | 7/2018 | Kasai et al. | |
| 2006/0017774 | A1* | 1/2006 | Beak | B41J 2/04563 347/44 |
| 2012/0229553 | A1* | 9/2012 | Owaki | B41J 2/04563 347/19 |
| 2012/0306953 | A1 | 12/2012 | Kanno et al. | |
| 2013/0083130 | A1 | 4/2013 | Guan et al. | |
| 2015/0321470 | A1 | 11/2015 | Ike | |
| 2016/0297194 | A1 | 10/2016 | Sakurai et al. | |
| 2018/0037029 | A1 | 2/2018 | Hirayama | |

FOREIGN PATENT DOCUMENTS

| | | | |
|---|---|---|---|
| EP | 2581228 | A1 | 4/2013 |
| EP | 3050707 | A2 | 8/2016 |
| JP | 2008-23987 | A | 2/2008 |
| JP | 2012-250511 | A | 12/2012 |

* cited by examiner

FIG. 4A
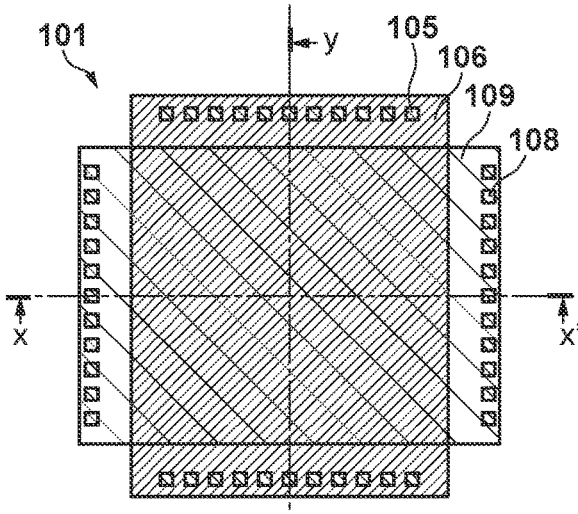
FIG. 4C
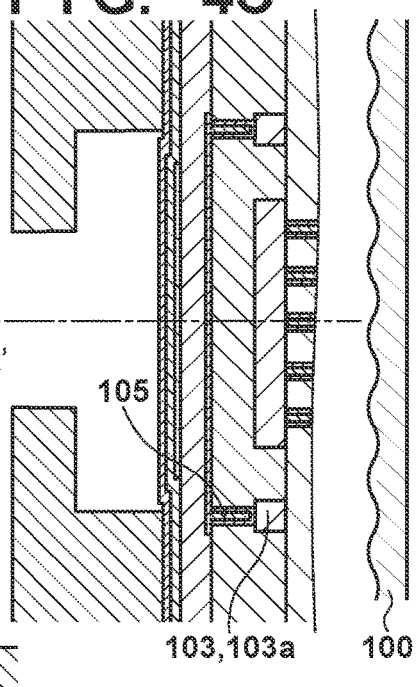
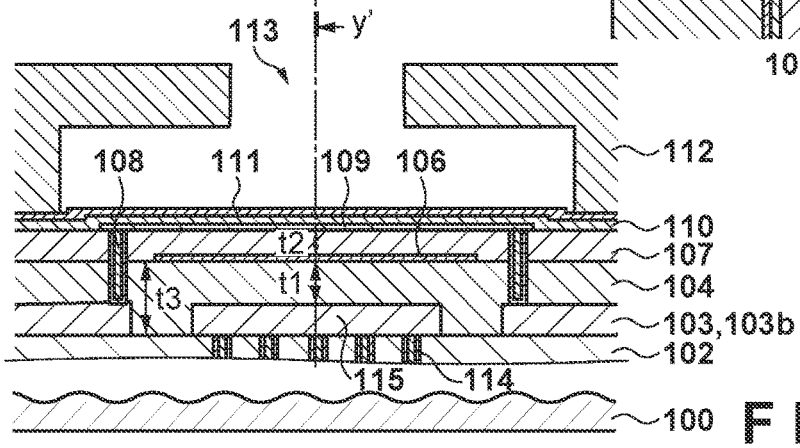
FIG. 4B
FIG. 4D
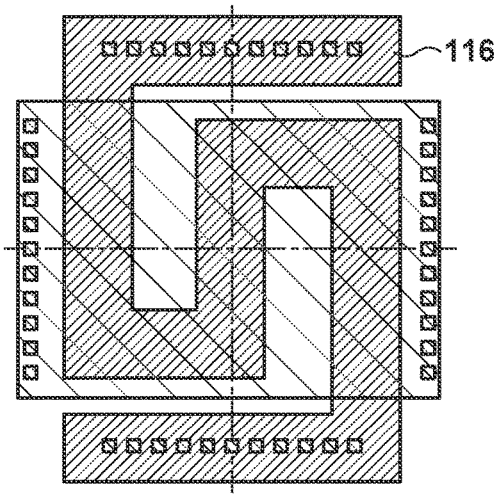
FIG. 4E
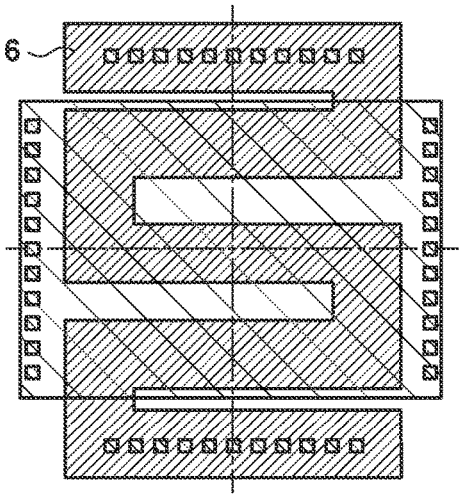

ELEMENT SUBSTRATE, MANUFACTURING METHOD THEREOF, PRINTHEAD, AND PRINTING APPARATUS

BACKGROUND OF THE INVENTION

Field of the Invention

The present invention relates to an element substrate, a manufacturing method of the element substrate, a printhead, and a printing apparatus, and particularly to, for example, a printing apparatus which is applied in order to perform, in accordance with an inkjet method, printing using a printhead which incorporates an element substrate for integrating a temperature detection element.

Description of the Related Art

For higher image quality and higher-speed printing, inkjet printheads have been changing to an arrangement in which there is a higher density of print elements and nozzles, and a large number of nozzles are arrayed. In recent years, in particular, there have been proposed a large number of full-line printheads where a plurality of element substrates are arranged across the width of a print medium such as a printing paper sheet.

On the other hand, as the number of nozzles increases, the probability that an ink discharge failure occurs in some nozzles due to nozzle clogging, bubbles trapped in an ink supply channel, leakage on a nozzle surface, or the like increases. To cope with this, a technique of specifying the nozzles where the discharge failure has occurred and giving feedback on them to image complementary printing or printhead recovery processing becomes more important. Japanese Patent Laid-Open Nos. 2008-023987 and 2012-250511 disclose an arrangement that provides each print element with a temperature detection element formed by a thin film resistor via an insulation film, detects temperature information for each nozzle, and specifies a nozzle suffering a discharge failure from a temperature change. A technique of giving feedback to image complementary printing or printhead recovery processing by this is proposed.

Japanese Patent Laid-Open No. 2012-250511 discloses a method of conducting a discharge inspection by applying a driving pulse that emphasizes the temperature change in order to facilitate detection. Such a driving method for conducting a discharge inspection is effective. In order to greatly improve sensitivity to detect the temperature change, however, it is desirable that a structure in which each temperature detection element is arranged immediately below a corresponding one of the print elements via the insulation film is adopted, and a distance between the print element and the temperature detection element is made shorter as much as possible. Taking a printhead substrate disclosed in Japanese Patent Laid-Open No. 2012-250511 as an example, it is only necessary that an interlayer insulation film between a heater and a temperature detection element can be made thin.

However, the interlayer insulation film needs to have a thickness that ensures an electrical insulating property between a wiring and another wiring, and coverage of the wirings themselves. For the arrangement described in Japanese Patent Laid-Open No. 2012-250511, the interlayer insulation film needs to have a thickness that ensures coverage of a step portion caused by a thick film wiring connected to the temperature detection element. Thus, the distance between the print element and the temperature detection element is restricted by the thickness of an insulation film between wiring layers.

SUMMARY OF THE INVENTION

Accordingly, the present invention is conceived as a response to the above-described disadvantages of the conventional art.

For example, an element substrate, a manufacturing method of the element substrate, a printhead, and a printing apparatus according to this invention are capable of forming an interlayer insulation film between an electrothermal transducer and a temperature detection element thin, and improving temperature detection sensitivity.

According to one aspect of the present invention, there is provided an element substrate having a multilayered structure comprising: a base; a wiring layer formed on a side of a front surface of the base; a first interlayer insulation film configured to cover the wiring layer; a temperature detection element formed on a surface of the first interlayer insulation film; a first electrical connecting member configured to penetrate through the first interlayer insulation film, and electrically connect the temperature detection element and a wiring for the temperature detection element of the wiring layer; a second interlayer insulation film formed on a surface of the temperature detection element and the surface of the first interlayer insulation film; an electrothermal transducer arranged at a position where at least a part of the electrothermal transducer overlaps the temperature detection element when viewed from a direction perpendicular to the front surface of the base, and formed on a surface of the second interlayer insulation film; and a second electrical connecting member configured to penetrate through at least the second interlayer insulation film, and electrically connect the electrothermal transducer and a wiring for the electrothermal transducer of the wiring layer.

According to another aspect of the present invention, there is provided a manufacturing method of an element substrate having a multilayered structure comprising: forming a first interlayer insulation film configured to cover a wiring layer with respect to a base with the wiring layer being formed on a side of a front surface of the base; forming a first via hole configured to reach the wiring layer in the first interlayer insulation film; forming a first electrical connecting member by filling the first via hole with a metal material and smoothing a surface of the first interlayer insulation film; forming a temperature detection element in a region on the surface of the first interlayer insulation film including the first electrical connecting member; forming a second interlayer insulation film on the surface of the first interlayer insulation film and a surface of the temperature detection element; and forming an electrothermal transducer on a surface of the second interlayer insulation film.

According to still another aspect of the present invention, there is provided a printhead that uses an element substrate having a multilayered structure, uses an electrothermal transducer as a print element, and discharges ink by applying thermal energy to ink by the print element, comprising: an orifice provided near the print element and configured to discharge ink; a supply port configured to supply ink to the print element; and a pressure chamber configured to communicate with the supply port and the orifice, in which ink bubbles due to heat generation of the print element, wherein the element substrate comprises: a base; a wiring layer formed on a side of a front surface of the base; a first interlayer insulation film configured to cover the wiring layer; a temperature detection element formed on a surface of the first interlayer insulation film; a first electrical connecting member configured to penetrate through the first interlayer insulation film, and electrically connect the temperature detection element and a wiring for the temperature detection element of the wiring layer; a second interlayer insulation film formed on a surface of the temperature detection element and the surface of the first interlayer insulation film; an electrothermal transducer arranged at a position where at least a part of the electrothermal transducer overlaps the temperature detection element when viewed from a direction perpendicular to the front surface of the base, and formed on a surface of the second interlayer insulation film; and a second electrical connecting member configured to penetrate through at least the second interlayer insulation film, and electrically connect the electrothermal transducer and a wiring for the electrothermal transducer of the wiring layer.

According to still another aspect of the present invention, there is provided a printing apparatus which prints an image by discharging ink to a print medium by using a printhead that uses an element substrate having a multilayered structure, uses an electrothermal transducer as a print element, and discharges ink by applying thermal energy to ink by the print element, wherein the printhead comprises: an orifice provided near the print element and configured to discharge ink; a supply port configured to supply ink to the print element; and a pressure chamber configured to communicate with the supply port and the orifice, in which ink bubbles due to heat generation of the print element, wherein the element substrate comprises: a base; a wiring layer formed on a side of a front surface of the base; a first interlayer insulation film configured to cover the wiring layer; a temperature detection element formed on a surface of the first interlayer insulation film; a first electrical connecting member configured to penetrate through the first interlayer insulation film, and electrically connect the temperature detection element and a wiring for the temperature detection element of the wiring layer; a second interlayer insulation film formed on a surface of the temperature detection element and the surface of the first interlayer insulation film; an electrothermal transducer arranged at a position where at least a part of the electrothermal transducer overlaps the temperature detection element when viewed from a direction perpendicular to the front surface of the base, and formed on a surface of the second interlayer insulation film; and a second electrical connecting member configured to penetrate through at least the second interlayer insulation film, and electrically connect the electrothermal transducer and a wiring for the electrothermal transducer of the wiring layer.

According to still another aspect of the present invention, there is provided an element substrate having a multilayered structure comprising: a base; a wiring layer formed on a side of a front surface of the base; a first interlayer insulation film configured to cover the wiring layer; a temperature detection element formed on a surface of the first interlayer insulation film; a first electrical connecting member configured to penetrate through the first interlayer insulation film, and electrically connect the temperature detection element and a wiring for the temperature detection element of the wiring layer; a second interlayer insulation film which is formed on a surface of the temperature detection element and the surface of the first interlayer insulation film, and is thinner than the first interlayer insulation film; an electrothermal transducer formed on a surface of the second interlayer insulation film; and a second electrical connecting member configured to penetrate through at least the second interlayer insulation film, and electrically connect the electrothermal transducer and a wiring for the electrothermal transducer of the wiring layer.

The invention is particularly advantageous since it is possible to form the interlayer insulation film between the electrothermal transducer and the temperature detection element thin, and improve temperature detection sensitivity. This improves, for example, the detection accuracy of an ink discharge state of an inkjet printhead that incorporates the element substrate.

Further features of the present invention will become apparent from the following description of exemplary embodiments with reference to the attached drawings.

BRIEF DESCRIPTION OF THE DRAWINGS

FIGS. 4A, 4B, 4C, 4D and 4E are views showing the element substrate where a print element, a temperature detection element, and a wiring are formed in a multilayered structure;

DESCRIPTION OF THE EMBODIMENTS

Exemplary embodiments of the present invention will now be described in detail in accordance with the accompanying drawings.

In this specification, the terms "print" and "printing" not only include the formation of significant information such as characters and graphics, but also broadly include the formation of images, figures, patterns, and the like on a print medium, or the processing of the medium, regardless of whether they are significant or insignificant and whether they are so visualized as to be visually perceivable by humans.

Also, the term "print medium (or sheet)" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be broadly interpreted to be similar to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium.

Further, a "nozzle (to be also referred to as a "print element" hereinafter)" generically means an ink orifice or a liquid channel communicating with it, and an element for generating energy used to discharge ink, unless otherwise specified.

An element substrate for a printhead (head substrate) used below means not merely a base made of a silicon semiconductor, but an arrangement in which elements, wirings, and the like are arranged.

Further, "on the substrate" means not merely "on an element substrate", but even "the surface of the element substrate" and "inside the element substrate near the surface". In the present invention, "built-in" means not merely arranging respective elements as separate members on the base surface, but integrally forming and manufacturing respective elements on an element substrate by a semiconductor circuit manufacturing process or the like.

<Overview of Printing Apparatus (FIGS. 1 and 2)>

Figure 1:
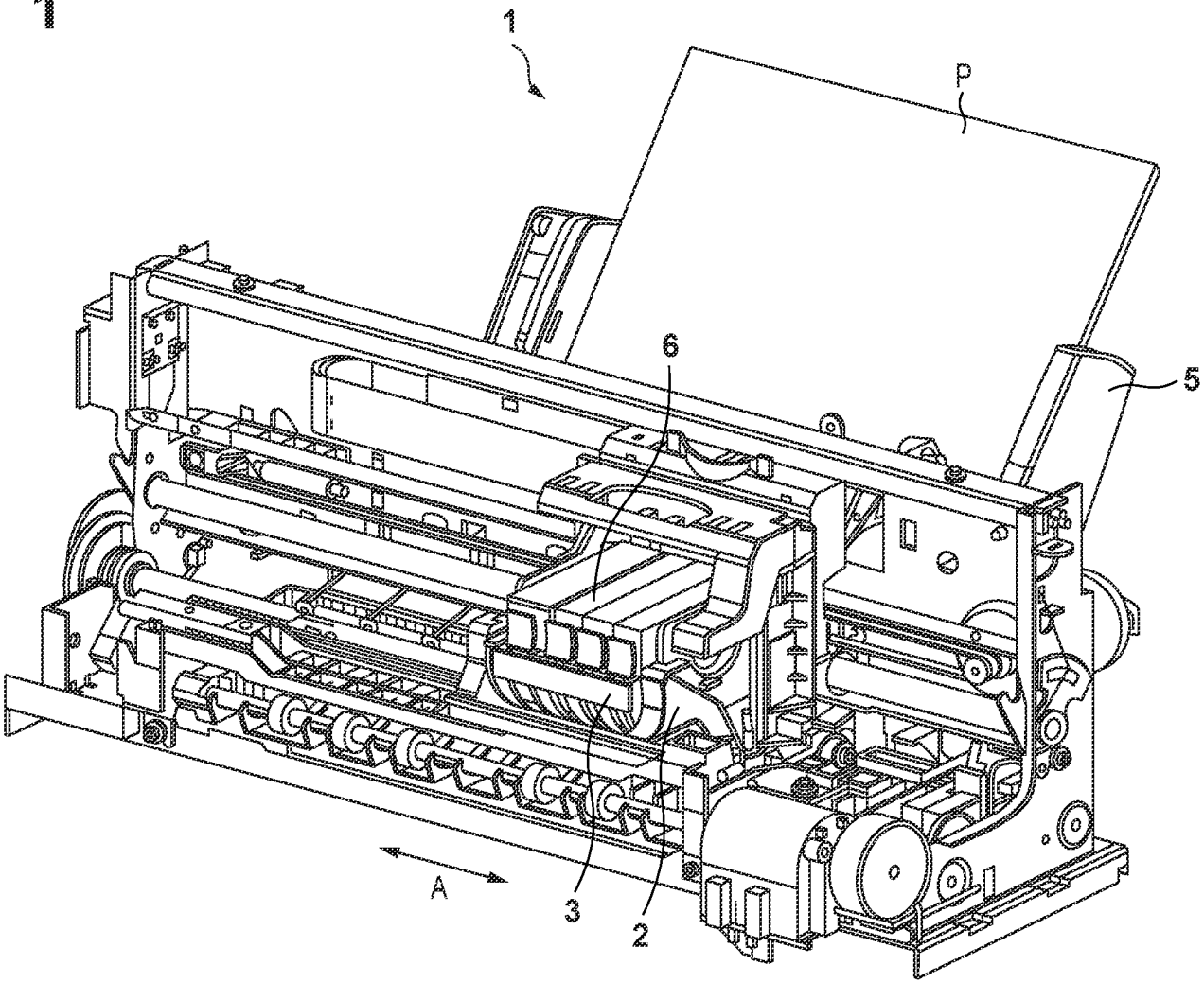
FIG. 1 is a perspective view showing the schematic arrangement of a printing apparatus which includes a printhead according to an exemplary embodiment of the present invention.

FIG. 1 is an outside perspective view showing the schematic arrangement of a printing apparatus that performs printing by using an inkjet printhead (to be referred to as a printhead hereinafter) according to an exemplary embodiment of the present invention.

As shown in FIG. 1, an inkjet printing apparatus (to be referred to as a printing apparatus hereinafter) 1 mounts, on a carriage 2, an inkjet printhead (to be referred to as a printhead hereinafter) 3 that performs printing by discharging ink in accordance with an inkjet method, and reciprocally moves the carriage 2 in the direction of an arrow A, thereby performing printing. A print medium P such as print paper is fed via a feed mechanism 5 and conveyed up to a print position. At the print position, the printhead 3 discharges ink to the print medium P, thereby performing printing.

Not only the printhead 3 is mounted on the carriage 2 of the printing apparatus 1. An ink tank 6 that stores ink to be supplied to the printhead 3 is also attached to the carriage 2. The ink tank 6 is detachable from the carriage 2.

The printing apparatus 1 shown in FIG. 1 can perform color printing. For this purpose, four ink cartridges that store magenta (M), cyan (C), yellow (Y), and black (K) inks, respectively, are mounted on the carriage 2. The four ink cartridges can independently be detached.

The printhead 3 according to this embodiment employs an inkjet method of discharging ink using thermal energy. Hence, the printhead 3 includes an electrothermal transducer (heater). The electrothermal transducer is provided in correspondence with each orifice. When a pulse voltage is applied to a corresponding electrothermal transducer in accordance with a print signal, ink is discharged from a corresponding orifice. Note that the printing apparatus is not limited to the above-described serial type printing apparatus and is also applicable to a so-called full-line type printing apparatus which arranges, in the conveyance direction of the print medium, a printhead (line head) with orifices arrayed in the widthwise direction of the print medium.

Figure 2:
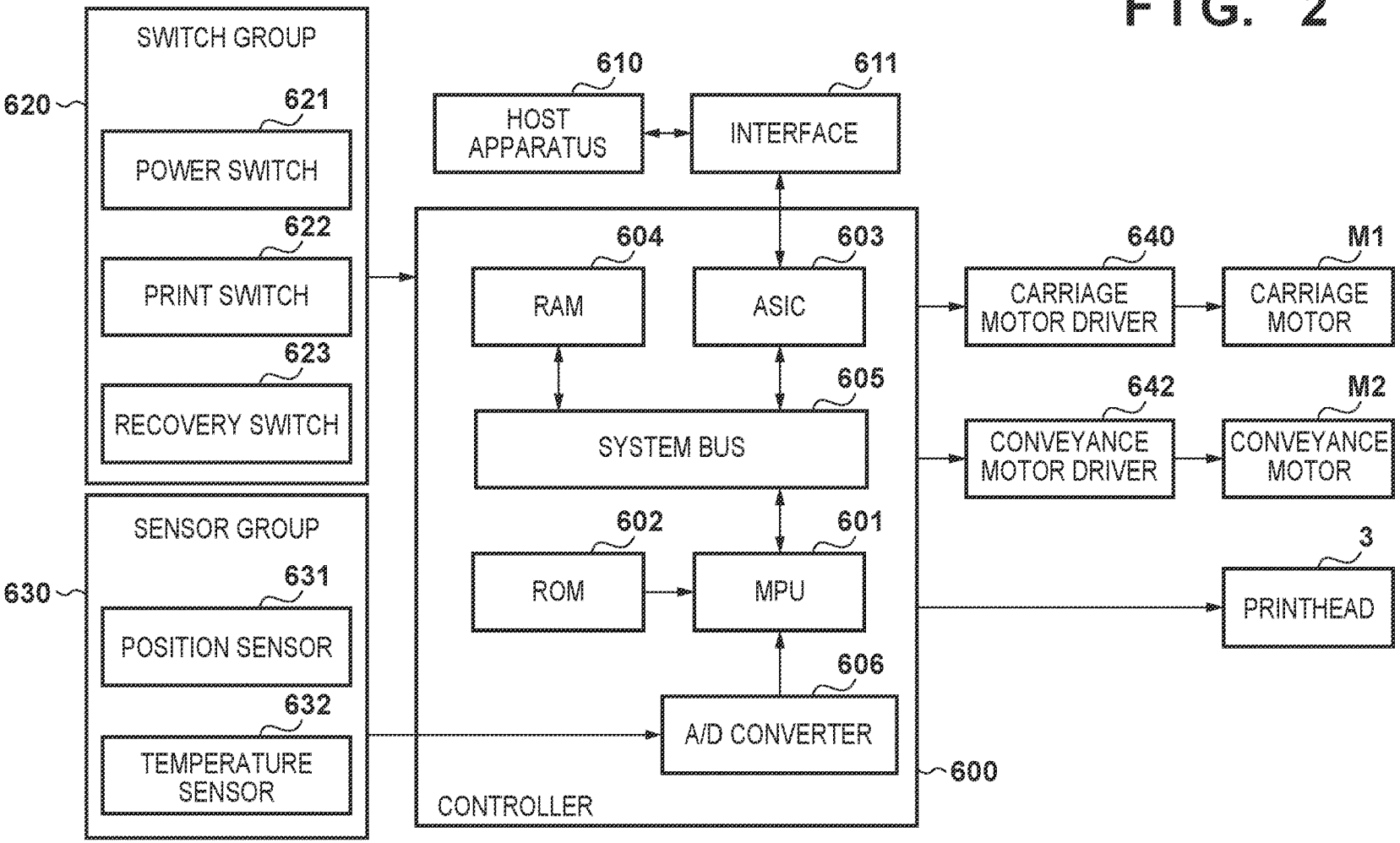
FIG. 2 is a block diagram showing the control configuration of the printing apparatus shown in FIG. 1.

FIG. 2 is a block diagram showing the control configuration of the printing apparatus shown in FIG. 1.

As shown in FIG. 2, a controller 600 is formed from an MPU 601, a ROM 602, an application specific integrated circuit (ASIC) 603, a RAM 604, a system bus 605, an A/D converter 606, and the like. Here, the ROM 602 stores a program corresponding to a control sequence to be described later, a required table, and other permanent data. The ASIC 603 generates control signals for control of a carriage motor M1, control of a conveyance motor M2, and control of the printhead 3. The RAM 604 is used as a rasterization area for image data, a work area for program execution, and the like. The system bus 605 connects the MPU 601, the ASIC 603, and the RAM 604 to each other and exchanges data. The A/D converter 606 receives an analog signal from a sensor group to be described below, A/D-converts the signal, and supplies a digital signal to the MPU 601.

Also, referring to FIG. 2, reference numeral 610 denotes a host apparatus that corresponds to a host or an MFP shown in FIG. 1 serving as an image data supply source. The host apparatus 610 and the printing apparatus 1 transmit/receive image data, commands, statuses, and the like via an interface (I/F) 611 by packet communication. This packet communication will be described later. Note that a USB interface may be provided as the interface 611 in addition to a network interface, thereby making it possible to receive bit data or raster data serially transferred from the host.

In addition, reference numeral 620 denotes a switch group including a power switch 621, a print switch 622, a recovery switch 623, and the like.

Reference numeral 630 denotes a sensor group configured to detect an apparatus state, which includes a position sensor 631, a temperature sensor 632, and the like.

Furthermore, reference numeral 640 denotes a carriage motor driver that drives the carriage motor M1 configured to make the carriage 2 reciprocally scan in the direction of the arrow A; and 642, a conveyance motor driver that drives the conveyance motor M2 configured to convey the print medium P.

At the time of print scan by the printhead 3, the ASIC 603 transfers data used to drive a heating element (heater for ink discharge) to the printhead while directly accessing the storage area of the RAM 604. This printing apparatus additionally includes, as a user interface, a display unit formed by an LCD or LED.

Embodiments of the element substrate integrated on the printhead mounted in the printing apparatus with the above-described arrangement will be described next.

<Description of Element Substrate (FIGS. 3A to 4E)>

Figure 3A:
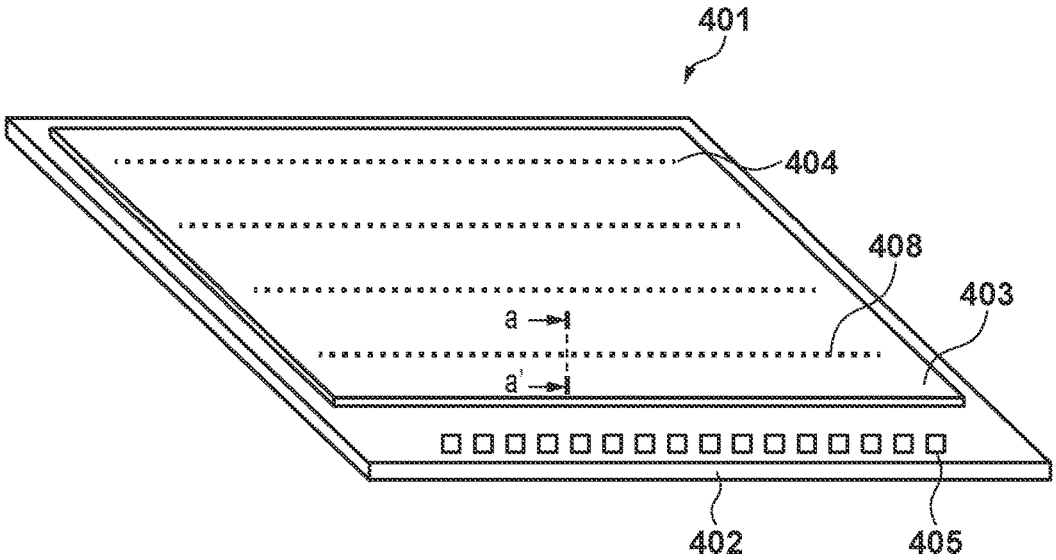
FIGS. 3A and 3B are layout views showing an element substrate.
Figure 3B:
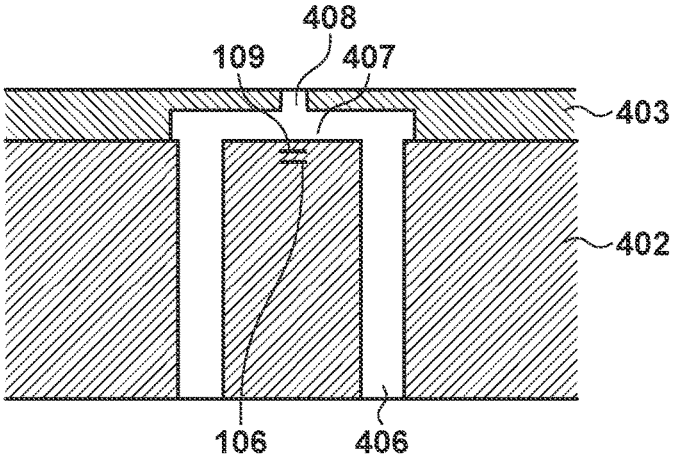

FIGS. 3A and 3B are views showing the layout of an element substrate. FIG. 3A is a view schematically showing the overall layout of a parallelogram element substrate 401 having angles (obtuse angles and acute angles) other than a right angle. FIG. 3B is a sectional view taken along a line a-a' of the element substrate 401.

To describe the arrangement of each layer of a base plate 402 below, a surface on a side where a nozzle plate 403 is provided is described as a front surface, and a surface on a side opposite to this is described as a back surface. In addition, in a layering direction on the base plate 402, a side on which the nozzle plate 403 is provided is described as an upper side, and an opposite side is described as a lower side.

As shown in FIG. 3A, in the nozzle plate 403 formed on the base plate 402, a plurality of nozzle arrays 404 are arrayed, in which a plurality of orifices 408 provided at a predetermined interval are arrayed. Then, a print element and a temperature detection element are built-in in the base plate 402 so as to correspond to each orifice. An example in which four nozzle arrays 404 are arranged is shown here. Electrode terminals 405 connected to an external wiring are provided in the peripheral portion of the base plate 402.

As shown in FIG. 3B, a print element 109 and a temperature detection element 106 provided immediately below it are arranged, as a pair, in a beam portion between independent supply ports 406. In the nozzle plate 403, a pressure chamber 407 and the orifice 408 that communicate with the independent supply ports 406 of an ink channel so as to correspond to the print element 109 are formed. Heat is generated when the print element 109 is energized. Ink bubbles in the pressure chamber when it is heated. Then, ink droplets are discharged from the orifices 408 due to the bubbling. Note that an arrangement, which uses one of the independent supply ports 406 provided on the both sides of the print element 109 as a discharge port and circulates ink so as to flow the ink from a supply port to the discharge port via the print element 109, may be adopted.

FIGS. 4A to 4E are views showing a multilayered structure 101 which includes the print element formed on the base plate and its neighboring portion.

FIG. 4A is a plan view showing a state in which the temperature detection element 106 is arranged in the form of a sheet on an interlayer insulation film 107 in a layer immediately below the print element 109. FIG. 4B is a sectional view taken along a dashed-dotted line x-x' in FIG. 4A. FIG. 4C is a sectional view taken along a dashed-dotted line y-y' perpendicular to the broken line x-x' in FIG. 4A. Note that the temperature detection element 106 and the print element 109 are preferably arranged so as to overlap at least partially when viewed from a layering direction (a direction perpendicular to the surface of a silicone base).

Referring to FIGS. 4B and 4C, a wiring 103 made of aluminum or the like is formed on an insulation film 102 layered on a silicone base 100, and an interlayer insulation film 104 is further formed on the wiring 103. The surface of the interlayer insulation film 104 is smoothed. The wiring 103, and the temperature detection element 106 which serves as a thin film resistor formed from a layered film of titanium and titanium nitride, and the like are electrically connected via conductive plugs 105 (electrical connecting members) which are embedded in the interlayer insulation film 104 and made of tungsten or the like. In addition, the interlayer insulation film 107 for ensuring insulation between the temperature detection element 106 and the print element 109 is formed so as to cover the temperature detection element 106. With such an arrangement, the interlayer insulation film 107 that covers the temperature detection element 106 only needs to ensure insulation between the print element 109 and the temperature detection element 106 which is a thin film of about several ten nm, making it possible to make the interlayer insulation film 107 thin. Note that it is possible to make a thickness t2 of the interlayer insulation film 107 smaller than a thickness t3 (the thickness of a portion without the wiring 103) of the interlayer insulation film 104 which covers the wiring 103 having a thickness large enough to supply a current for driving the print element 109.

Then, the wiring 103 and the print element 109 that operates as an electrothermal transducer (heater) and is formed by a tantalum silicon nitride film or the like are electrically connected via conductive plugs 108 (electrical connecting members) which penetrate through the interlayer insulation film 104 and the interlayer insulation film 107, and made of tungsten or the like.

Note that instead of the conductive plugs 108, electrical connecting members may be used, which are formed by connecting conductive plugs which penetrate through the interlayer insulation film 104, and conductive plugs which are formed by a different process from that of the other conductive plugs and penetrate through the interlayer insulation film 107 via a spacer formed by an intermediate wiring layer. When thus connecting the conductive plugs in a lower layer and the conductive plugs in an upper layer, they are generally connected by sandwiching the spacer formed by the intermediate wiring layer. Applied to this embodiment, however, since the film thickness of the temperature detection element serving as the intermediate wiring layer is as small as about several ten nm, the accuracy of overetching control with respect to a temperature detection element film serving as the spacer is required when forming a via hole. Moreover, the thin film is also disadvantageous in pattern miniaturization of a temperature detection element layer.

Considering this situation, it is preferable that the conductive plugs 108 are adopted, which penetrate through the interlayer insulation film 104 and the interlayer insulation film 107 as in this embodiment.

Note that the wiring 103 includes a wiring 103*a* for a temperature detection element connected to the temperature detection element 106 and a wiring 103*b* for a print element (wiring for the electrothermal transducer) connected to the print element 109. These wiring 103*a* and wiring 103*b* are electrically independent of each other. In this embodiment, the respective wiring 103*a* and wiring 103*b* are formed from the wiring 103 formed as the same layer. However, the respective wirings may be formed from wiring layers formed as different layers in the layering direction.

Next, the base plate 402 is obtained by forming a protective film (coated membrane) 110 such as a silicon nitride film, and then forming an anti-cavitation film 111 that contains tantalum or iridium or includes a layered film of tantalum and iridium on the protective film 110. Furthermore, an orifice 113 is formed by a nozzle forming member 112 made of a photosensitive resin or the like.

Note that in this embodiment, the print element 109 and the thick film wiring 103 arranged in the lower layer are connected via the conductive plugs 108. In addition, the surface of the interlayer insulation film 107 is smoothed. Thus, a step caused by the thick film wiring 103 is not created on the surface side of the element substrate, making it possible to ensure coverage even if the protective film 110 that covers the print element 109 is made thin. It is therefore possible to shorten a distance from the temperature detection element 106 to an interface with ink by forming the protective film 110 thin, and to increase sensitivity to detect a temperature state on the surface of the anti-cavitation film 111 which serves as the interface with ink.

As described above, the element substrate of this embodiment has the multilayered structure 101 where an independent intermediate layer of the temperature detection element 106 is provided between the layer of the print element 109 and the layer of the wiring 103 (to be referred to as the wiring layer 103 hereinafter). Note that the plurality of interlayer insulation films 104 each in which the wiring layer 103 is embedded may be layered on the lower side of the temperature detection element 106. In this case, a plurality of wiring layers embedded in different interlayer insulation films may be connected via a plug.

Note that the nozzle forming member 112 corresponds to the nozzle plate 403 in FIGS. 3A and 3B.

As shown in FIG. 4A, the plurality of conductive plugs 108 that connect the print element 109 and the wiring layer 103 are provided along the left and right edge portions of the print element 109. On the other hand, the plurality of conductive plugs 105 that connect the temperature detection element 106 and the wiring layer 103 are provided along the upper and lower edge portions of the temperature detection element 106. Thus, the conductive plugs 108 and the conductive plugs 105 are provided at different positions, and a direction in which the plurality of conductive plugs 108 are arrayed and a direction in which the plurality of conductive plugs 105 are arrayed cross each other (in this embodiment, they are orthogonal to each other).

With such an array of the conductive plugs, a region where the temperature detection element film and a print element film overlap increases when viewing the element substrate from an upper surface, allowing the temperature detection element film to detect heat conducted by a temperature change of the print element more efficiently. As a result, temperature detection with higher sensitivity is implemented. In addition, the arrangement positions of the conductive plugs 108 that perform electrical connection between the print element 109 and the wiring layer 103, and the conductive plugs 105 that perform electrical connection between the temperature detection element 106 and the wiring layer 103 are changed, and they are arranged in a region other than the region where the temperature detection element film and the print element film overlap. With this arrangement, in addition to an improvement in sensitivity of the temperature detection element, a planar region of the element substrate is used effectively to suppress an increase in size of the element substrate 401.

Note that as for the conductive plugs 105 connected to the temperature detection element 106, it is only necessary that at least a pair of conductive plugs 105 is provided in order to supply a current to the temperature detection element 106. In addition, as for the conductive plugs 108 connected to the print element 109, it is only necessary that at least a pair of conductive plugs 108 is provided in order to supply a current to the print element 109. One of at least the pair of conductive plugs 108 is connected to one end of the print element 109 in a right-and-left direction (first direction) of FIG. 4A, and the other of at least the pair of conductive plugs 108 is connected to the other end. Moreover, at least the pair of conductive plugs 105 are arranged to be spaced apart from each other in a longitudinal direction (second direction) of FIG. 4A. Note that this embodiment adopts an arrangement in which the plurality of conductive plugs 105 are arrayed in one edge portion of the temperature detection element 106 as shown in FIG. 4A. However, this embodiment may adopt an arrangement which provides one conductive plug of a shape extending in this arrayed direction. In addition, the conductive plugs 108 connected to the print element 109 may also have the same arrangement.

Heat conduction considered in the multilayered structure of this embodiment will be described next.

When using, as a print element, an electrothermal transducer (heater) formed in the multilayered structure, a heat storage layer having heat conductivity which is low to some extent preferably exists between the print element and the silicone base in order to apply heat to ink efficiently. On the other hand, in order to drive the print element at a high speed, heat conductivity to some extent is also required so unnecessary ink bubbling does not occur by diffusing excess heat quickly.

In this embodiment, the interlayer insulation film 104 arranged immediately below the print element 109 functions as a heat storage layer having a thickness t1, and the interlayer insulation film 107 arranged immediately below the print element 109 functions as a heat storage layer having a thickness t2. As shown in FIGS. 4B and 4C, a metal layer 115 for heatsink is also provided immediately below the print element 109. Plugs 114 for heatsink are further provided, which contact the back surface of this metal layer 115, elongate toward the front surface of the silicone base 100, and are configured to conduct heat to the silicone base 100. These plugs 114 and the metal layer 115 form a heat dissipation channel from the print element 109. The metal layer 115 for heatsink is arranged at a position overlapping at least parts of the print element 109 and temperature detection element 106 when viewed from the layering direction, and has the same shape as the print element 109. The metal layer 115 which also serves as a portion of the wiring 103 is electrically independent of the above-described wiring 103*a* and wiring 103*b*.

Note that the thickness t1 is the thickness of a portion of the interlayer insulation film 104 located on the metal layer 115. Further, the thickness t2 is the thickness of a portion of the interlayer insulation film 107 located on the temperature detection element 106. With such a heat dissipation channel, the arrangement has appropriate heat storage and heatsink characteristics.

Next, a requirement to provide the layer of the temperature detection element 106 between the print element 109 and the metal layer 115 will be given.

The interlayer insulation film 107 having the thickness t2 needs to assuredly insulate the temperature detection element 106 and the print element 109, further suppress the influence of an action of the temperature detection element 106 as a heat dissipation element, and be set in a range that satisfies these. It is therefore preferable that the thickness t2 of the interlayer insulation film 107 is equal to or more than 0.2 μm. On the other hand, in order to improve the sensitivity of the temperature detection element 106, the thickness t2 of the interlayer insulation film 107 is preferably 0.5 μm or less. That is, it is preferable that the thickness t2 of the interlayer insulation film 107=0.2 μm to 0.5 μm.

From the viewpoint of heat storage, a total thickness t1+t2 of the interlayer insulation film 104 and the interlayer insulation film 107 serving as the heat storage layers needs to be a predetermined thickness. In order to assuredly cover the wiring layer 103, the interlayer insulation film 104 is generally formed such that the thickness t1 becomes equal to or larger than the thickness of the wiring layer 103. Note that a large current flows because the wiring layer 103 is a wiring of a power source driven by the print element 109 or a GND. Therefore, in order to satisfy a reduction in resistance and a predetermined current density or less, the wiring layer 103 needs to have a sufficient thickness of about several μm (for example, 1 μm). Note that the metal layer 115 formed by the same process as the wiring layer 103 is also formed with the same thickness as the wiring layer 103.

That is, it is required that the total thickness t1+t2 as the heat storage layers has the predetermined thickness while increasing t1 in order to cover the wiring layer 103 which has sufficient thickness. On the other hand, the interlayer insulation film 107 is required to obtain sensitivity to a temperature change as much as possible while satisfying requirements of insulation properties and a heatsink influence. In order to satisfy these requirements, the distribution ratio of the thicknesses t1 and t2 is preferably set to t1>t2 as in this embodiment.

As shown in FIG. 4A, the conductive plugs 105 of the temperature detection element 106 are provided in a region which does not overlap the print element 109 in order to suppress heat dissipation from the print element 109. That is, the conductive plugs 105 of the temperature detection element 106 are provided in a region which does not overlap the print element 109 when viewed form the layering direction. Furthermore, by providing the conductive plugs 105 in the region which does not overlap the print element 109, a temperature is detected in a whole area immediately below the print element. This is also advantageous in obtaining a detection signal with as large dynamic range as possible.

FIGS. 4D and 4E are views, each showing another shape of a temperature detection element adapted to the multilayered structure according to this embodiment.

As shown in FIGS. 4D and 4E, the shape of a temperature detection element 116 is a meander shape with a plurality of folds. A planar shape of the temperature detection element 116 shown in FIG. 4D is a shape folded in the y direction (top to bottom direction in FIG. 4D), while a planar shape of the temperature detection element 116 shown in FIG. 4E is a shape folded in the x direction (left to right direction in FIG. 4E). These shapes increase a resistance value and is effective when generating a larger detection voltage.

<Heat Conductive Property (FIG. 5)>

Figure 5:
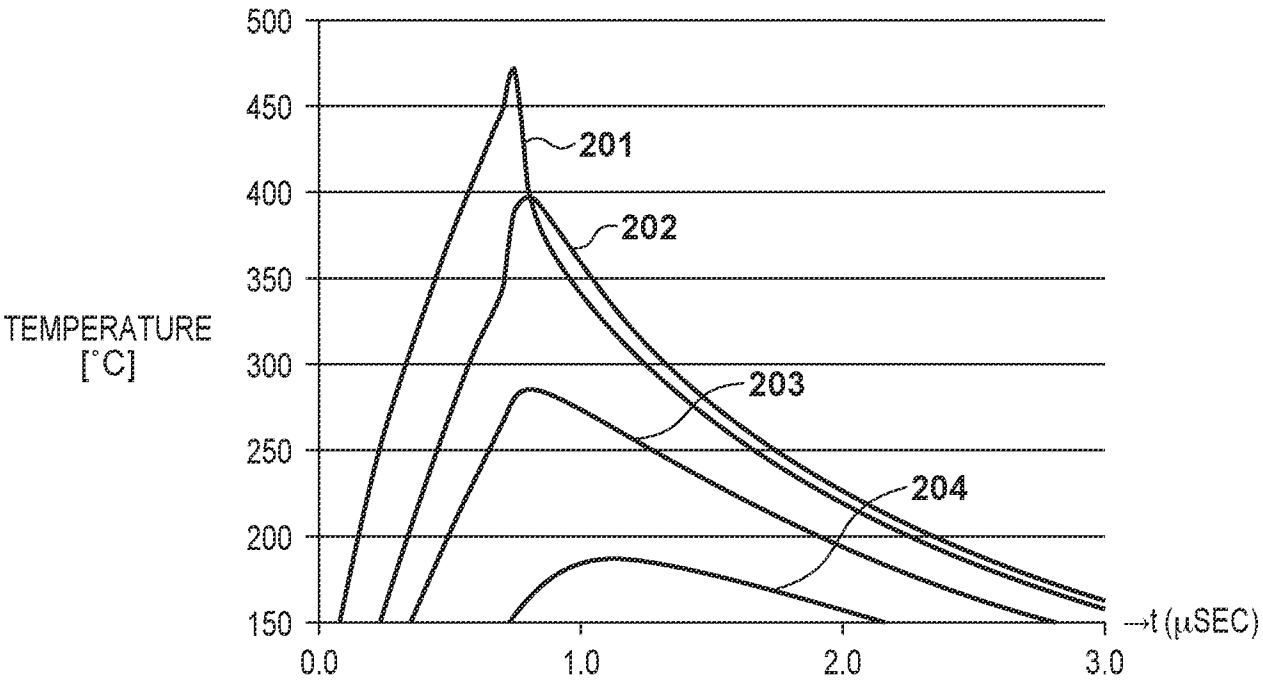
FIG. 5 is a graph showing temperature waveforms obtained by performing a heat conduction calculation on a temperature response of the temperature detection element.

FIG. 5 is a graph showing a result of performing heat conduction calculation on a temperature response of the temperature detection element 106 when the interlayer insulation film 107 has the thickness t2.

Conditions for this calculation are as follows.

the thickness (t2) of the interlayer insulation film 107:

t2=0.4 μm, t2=0.9 μm the size of the print element 109 serving as a heat source:

width 15.6 μm×length 23.6 μm×thickness 20 nm heat generation amount: $4.8\times10^{16}$ w/m$^3$ heat generation time: 0.7 μsec initial temperature: room temperature Referring to FIG. 5, a waveform 201 indicates a temperature change of the print element 109, a waveform 202 indicates a temperature change of the anti-cavitation film 111, a waveform 203 indicates a temperature change of the interlayer insulation film 107 having the thickness t2=0.4 μm, and a waveform 204 indicates a temperature change of the interlayer insulation film 107 having the thickness t2=0.9 μm. From comparison between the waveform 203 and the waveform 204, it is found that the temperature change of the interlayer insulation film having the thickness t2=0.4 μm becomes higher than the temperature change of the interlayer insulation film having the thickness t2=0.9 μm by about 100° C. at a peak temperature. It is also found that the thickness t2 of the interlayer insulation film 107 is preferably 0.4 μm or less, in particular.

By thus making the interlayer insulation film 107 between the print element 109 and the temperature detection element 106 thin, a sharp high-speed temperature waveform with suppressed attenuation is obtained, and sensitivity to detect a temperature state at the interface of the anti-cavitation film 111 improves.

<Element Substrate Manufacturing Process (FIGS. 6A to 6N)>

Figure 6A:
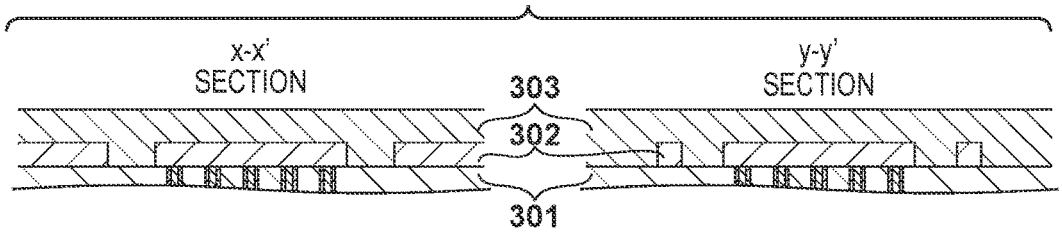
FIGS. 6A, 6B, 6C, 6D, 6E, 6F, 6G, 6H, 6I, 6J, 6K, 6L, 6M, and 6N are views showing a manufacturing method of the element substrate in the multilayered structure.
Figure 6B:
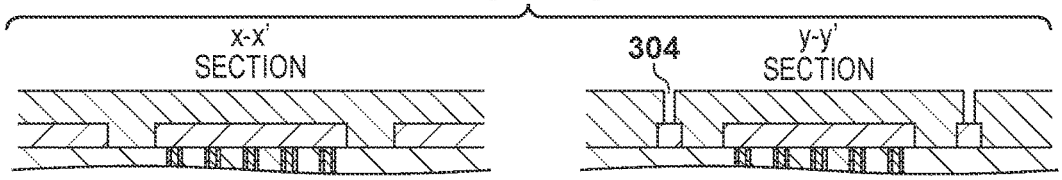
Figure 6C:
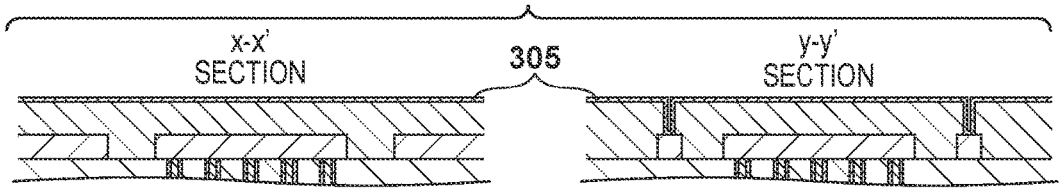
Figure 6D:
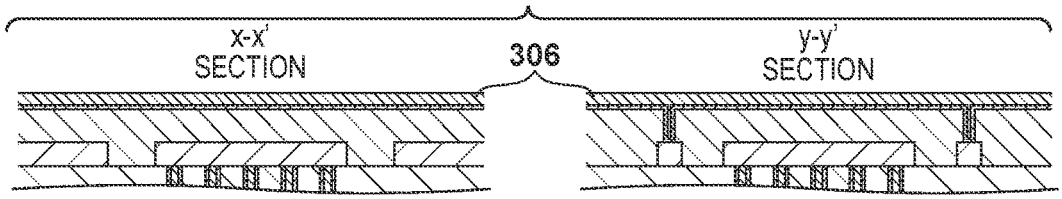
Figure 6E:
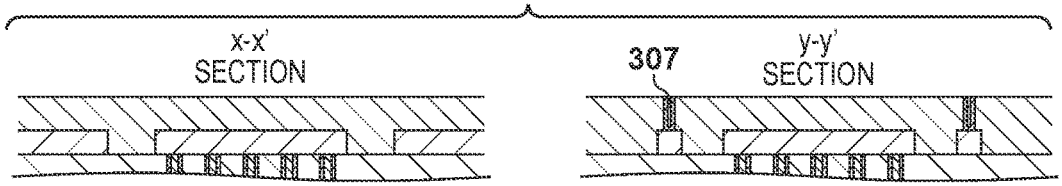
Figure 6F:
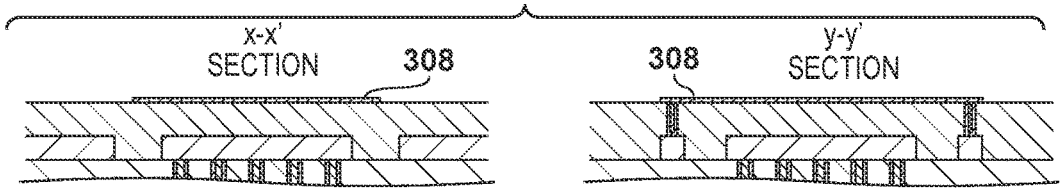
Figure 6G:
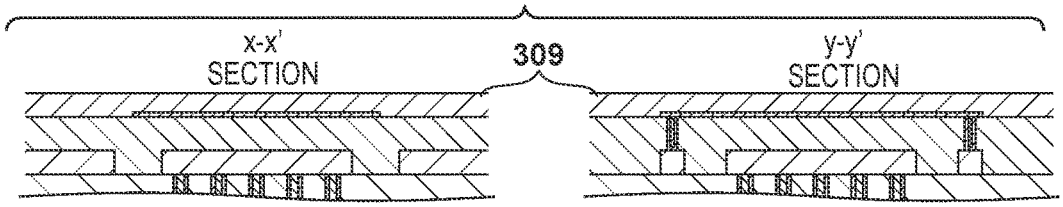
Figure 6H:
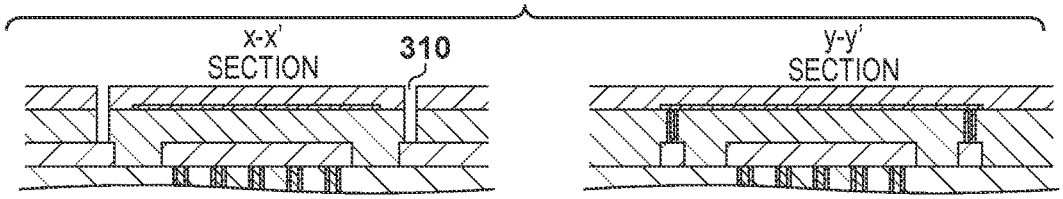
Figure 6I:
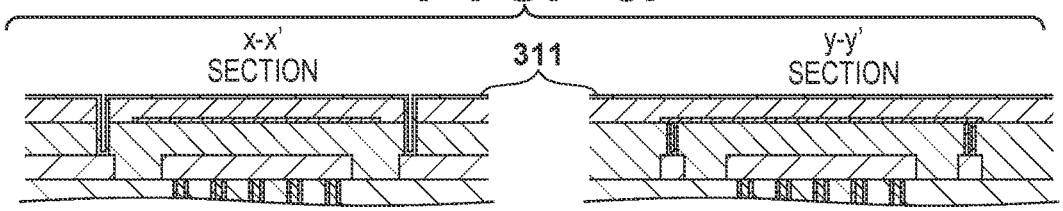
Figure 6J:
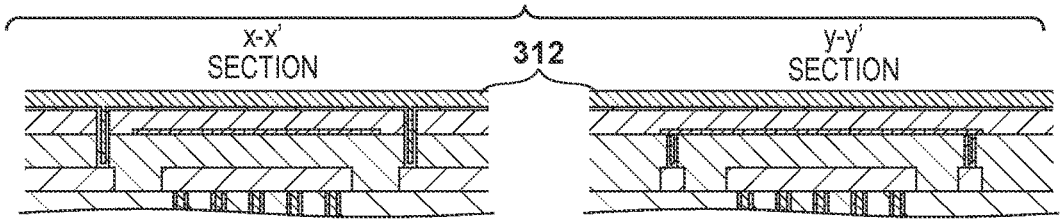
Figure 6K:
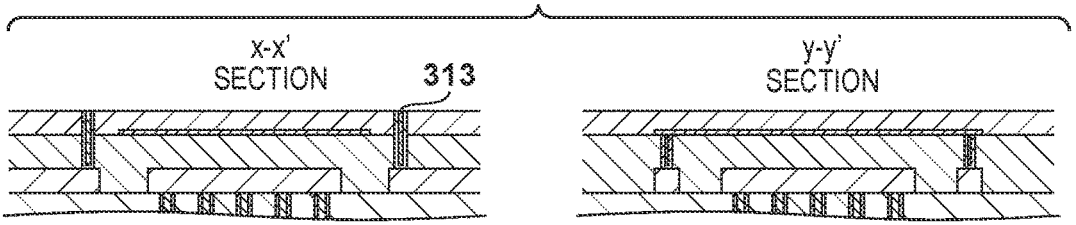
Figure 6L:
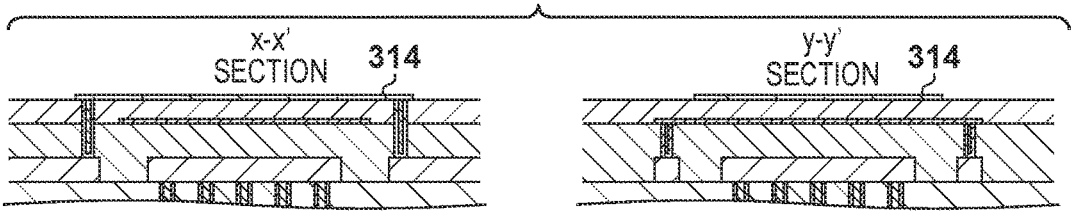
Figure 6M:
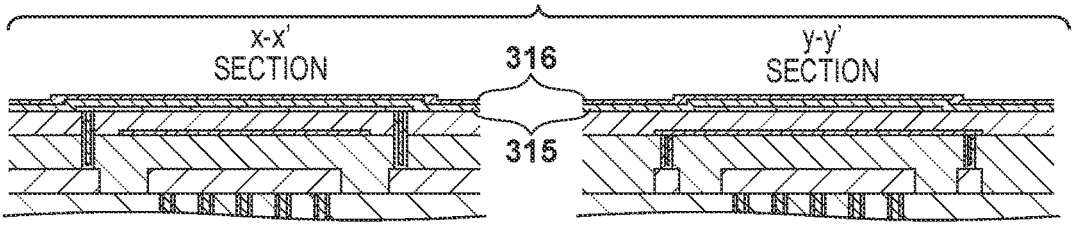
Figure 6N:
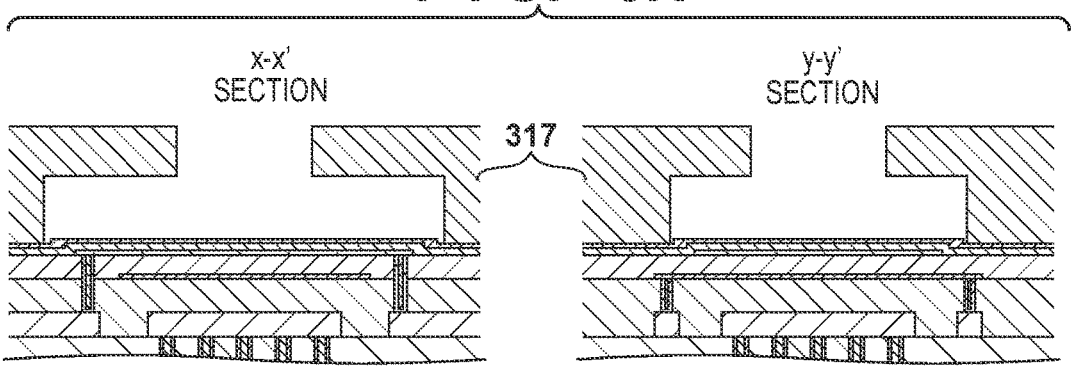

FIGS. 6A to 6N are views showing the sequence of a manufacturing process of the multilayered structure 101 corresponding to an x-x' sectional view shown in FIG. 4B and a y-y' sectional view shown in FIG. 4C. FIGS. 6A to 6N show 14 steps from steps A to N, and a time sequence in a direction from FIG. 6A to FIG. 6N. In each of FIGS. 6A to 6N, a left-side view corresponds to the x-x' sectional view shown in FIG. 4B, and a right-side view corresponds to the y-y' sectional view shown in FIG. 4C.

Step A (Formation and Smoothing of First Interlayer Insulation Film)

Above an insulation film 301 layered on the silicone base, an etching mask for patterning a wiring layer 302 is formed on the wiring layer 302 by photolithography. More specifically, a resist pattern is formed on a wiring layer by spin-coating a positive photosensitive resist material serving as a mask on a base plate, performing exposure via a photomask where a wiring pattern is drawn, and performing development.

Subsequently, a wiring pattern is formed by removing the wiring layer 302 in regions which are not masked with the resist pattern by dry etching. At this time, a photoresist is removed by plasma ashing after a metal film is anisotropically etched by reactive ion etching. When forming a wiring pattern from the wiring layer 302, a wiring for a temperature detection element connected to a temperature detection element 308 and a wiring for a print element connected to a print element 314 are formed to be electrically independent of each other. The above-described metal layer 115 for heatsink is also formed from the wiring layer 302. This makes it possible to suppress a load in the manufacturing process.

Subsequently, a silicon oxide film is formed on the wiring layer 302 as an interlayer insulation film 303. At this time, an HDP (High Density Plasma) oxide film, which is obtained by overlapping bias sputtering elements in order to embed the silicon oxide film in even a fine gap between wirings without any gap, also forms the interlayer insulation film 303 formed by the silicon oxide film in combination with a lower layer portion.

Subsequently, the upper surface of the interlayer insulation film 303 is smoothed by polishing the silicon oxide film by CMP (Chemical Mechanical Polishing).

Step B (Formation of Via Hole)

Via holes where conductive plugs are formed in the interlayer insulation film 303, which have a resist pattern with mask openings of via hole portions, are formed by the same process as photolithography described above. Subsequently, via holes 304 are formed by inductively coupled plasma reactive ion etching. Consequently, the surface of the wiring layer 302 for the temperature detection element is partially exposed from each via hole 304. In addition, a resist used as an etching mask is removed by performing plasma ashing.

Step C (Formation of First Barrier Metal)

A barrier metal 305 made of a layered film of a contact metal, titanium serving as a diffusion preventing film, and titanium nitride is formed by sputtering film forming.

Step D (Film Forming of First Tungsten Film)

By low-pressure CVD film forming, a tungsten film 306 is formed, as a conductive plug material, with a film thickness that fills the via holes sufficiently.

Step E (First Polishing)

By CMP, while leaving only conductive plugs 307 in the via holes, the barrier metal 305 and the tungsten film 306 on the interlayer insulation film 303 are polished to be removed without any residual, smoothing the surface of the interlayer insulation film 303.

Note that, for this step, there is also a method of removing the conductive plug material and the barrier metal by using etch back.

Step F (Formation of Temperature Detection Element)

Sputtering film forming is performed for the layered film of titanium and titanium nitride used as a temperature detection element of this embodiment. Subsequently, a resist mask is formed by photolithography, and a temperature detection element 308 is formed by dry etching.

Step G (Formation and Smoothing of Second Interlayer Insulation Film)

By plasma CVD, an interlayer insulation film 309 formed by a silicon oxide film is formed on the temperature detection element 308. Then, the silicon oxide film is polished by CMP, smoothing the upper surface of the interlayer insulation film 309.

Step H (Formation of Via Hole)

Via holes that penetrate through the interlayer insulation film 303 and the interlayer insulation film 309 are formed, which have a resist pattern with mask openings of via hole portions, are formed by the same process as photolithography described above. Subsequently, via holes 310 are formed by inductively coupled plasma reactive ion etching. Consequently, the surface of the wiring layer 302 for an electrothermal transducer is partially exposed from each via hole 310. Note that a resist used as an etching mask is removed by performing plasma ashing.

Step I (Formation of Second Barrier Metal)

A barrier metal 311 made of a layered film of a contact metal, titanium serving as a diffusion preventing film, and titanium nitride is formed by sputtering film forming.

Step J (Film Forming of Second Tungsten Film)

By low-pressure CVD film forming, a tungsten film 312 is formed, as a conductive plug material, with a film thickness that fills the via holes sufficiently.

Step K (Second Polishing)

By CMP the barrier metal 311 and the tungsten film 312 on the interlayer insulation film 309 are polished to be removed without any residual, smoothing the surface of the interlayer insulation film 309, while leaving only conductive plugs 313 in the via holes. Note that, for this step, there is also a method of removing the conductive plug material and the barrier metal by using etch back.

Step L (Formation of Print Element)

Sputtering film forming is performed for a film of a print element that serves as an electrothermal transducer (heater) which is formed by a tantalum silicon nitride film or the like used as a print element. Then, a resist mask is formed by photolithography, and the print element 314 is formed by dry etching.

Step M (Formation of Element Substrate)

An element substrate is obtained by forming a passivation film (protective film) 315 such as a silicon nitride film and an anti-cavitation film 316 made of tantalum or the like.

Step N (Formation of Orifice)

A photosensitive resin is used for a nozzle forming member 317, and an orifice is formed by using a photolithography technique.

Therefore, according to the above-described embodiment, because an interlayer insulation film between a print element and a temperature detection element can be made thin, a temperature change characteristic of the temperature detection element follows a temperature change of the print element satisfactorily, improving temperature detection sensitivity. This makes it possible to improve the detection accuracy of an ink discharge state.

Figure 7:
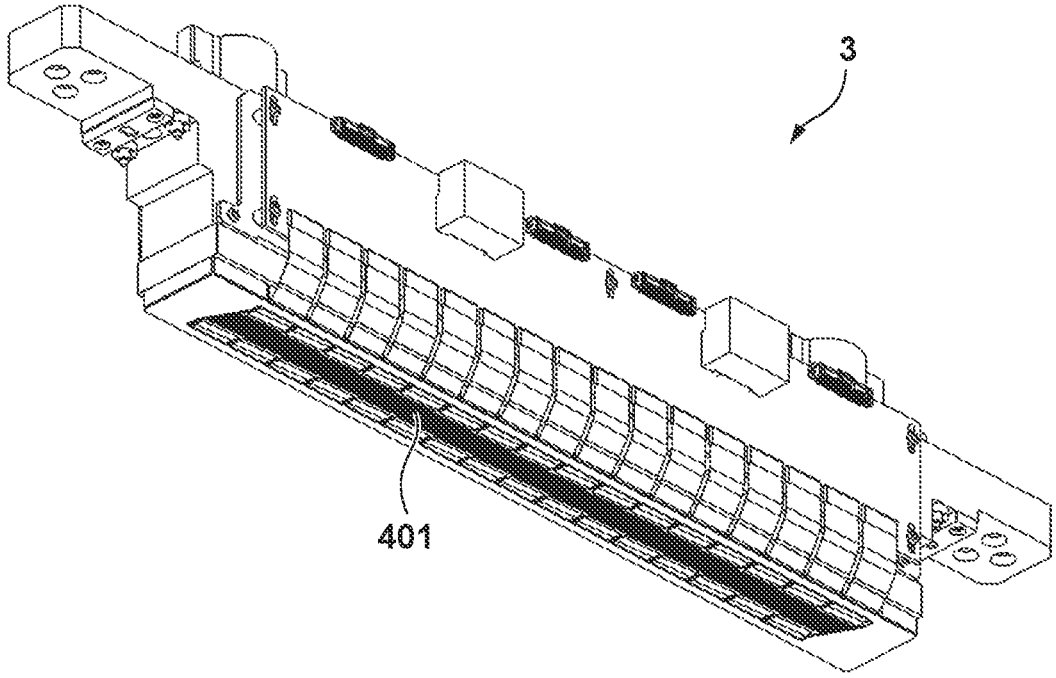
FIG. 7 is a perspective view showing a full-line printhead.

Note that as shown in FIG. 7, when the full-line printhead 3 is formed by arranging the plurality of element substrates 401, it is possible to arrange a plurality of element substrates in the same direction as a heater array direction.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-197771, filed Oct. 11, 2017, and Japanese Patent Application No. 2018-160602, filed Aug. 29, 2018 which are hereby incorporated by reference herein in their entirety.

What is claimed is:

1. An element substrate having a multilayered structure comprising:

a base;

a wiring layer formed on a side of a front surface of the base;

a first interlayer insulation film configured to cover the wiring layer;

a temperature detection element formed on a surface of the first interlayer insulation film;

a first electrical connecting member configured to penetrate through the first interlayer insulation film, and electrically connect the temperature detection element and a wiring for the temperature detection element of the wiring layer;

a second interlayer insulation film formed on a surface of the temperature detection element and the surface of the first interlayer insulation film;

an electrothermal transducer arranged at a position where at least a part of the electrothermal transducer overlaps the temperature detection element when viewed from a direction perpendicular to the front surface of the base, and formed on a surface of the second interlayer insulation film; and a second electrical connecting member configured to penetrate through at least the second interlayer insulation film, and electrically connect the electrothermal transducer and a wiring for the electrothermal transducer of the wiring layer.

2. The element substrate according to claim 1, wherein the first electrical connecting member is a first plug, and the second electrical connecting member is a second plug configured to penetrate through the first interlayer insulation film and the second interlayer insulation film.

3. The element substrate according to claim 1, wherein the first electrical connecting member is arranged in a region where the first electrical connecting member does not overlap the electrothermal transducer when viewed from the perpendicular direction.

4. The element substrate according to claim 1, wherein the first electrical connecting member and the second electrical connecting member are arranged in a region where the electrothermal transducer and the temperature detection element do not overlap when viewed from the perpendicular direction.

5. The element substrate according to claim 1, further comprising:

at least a pair of the first electrical connecting members; and at least a pair of the second electrical connecting members, wherein one of at least the pair of the second electrical connecting members is connected to one end of the electrothermal transducer in a first direction, and the other of at least the pair of the second electrical connecting members is connected to the other end of the electrothermal transducer in the first direction, and at least the pair of the first electrical connecting members are arranged to be spaced apart from each other in a second direction crossing the first direction.

6. The element substrate according to claim 2, wherein the first plug comprises a plurality of first plugs, and the second plug comprises a plurality of second plugs, and a direction in which the plurality of first plugs are arrayed and a direction in which the plurality of second plugs are arrayed cross each other.

7. The element substrate according to claim 1, wherein the temperature detection element has a meander shape.

8. The element substrate according to claim 1, wherein a thickness of the second interlayer insulation film is smaller than a thickness of the first interlayer insulation film.

9. The element substrate according to claim 1, wherein a thickness of a portion of the second interlayer insulation film located on the temperature detection element falls within a range of 0.2 μm (inclusive) to 0.5 μm (inclusive).

10. The element substrate according to claim 1, wherein a thickness of a portion of the second interlayer insulation film located on the temperature detection element is not more than 0.4 μm.

11. The element substrate according to claim 1, further comprising a metal layer arranged at a position where the metal layer overlaps at least parts of the electrothermal transducer and the temperature detection element when viewed form the perpendicular direction, and covered with the first interlayer insulation film, wherein a thickness of a portion of the second interlayer insulation film located on the temperature detection element is smaller than a thickness of a portion of the first interlayer insulation film located on the metal layer.

12. The element substrate according to claim 11, further comprising a plug configured to contact a back surface of a surface of the metal layer where the first interlayer insulation film is provided and elongate toward the front surface of the base.

13. The element substrate according to claim 1, wherein the surface of the first interlayer insulation film and the surface of the second interlayer insulation film are smoothed.

14. The element substrate according to claim 1, further comprising a coated membrane configured to cover the electrothermal transducer.

15. A manufacturing method of an element substrate having a multilayered structure comprising:

forming a first interlayer insulation film configured to cover a wiring layer with respect to a base with the wiring layer being formed on a side of a front surface of the base;

forming a first via hole configured to reach the wiring layer in the first interlayer insulation film;

forming a first electrical connecting member by filling the first via hole with a metal material and smoothing a surface of the first interlayer insulation film;

forming a temperature detection element in a region on the surface of the first interlayer insulation film including the first electrical connecting member;

forming a second interlayer insulation film on the surface of the first interlayer insulation film and a surface of the temperature detection element; and forming an electrothermal transducer on a surface of the second interlayer insulation film.

16. The method according to claim 15, further comprising:

forming, at a position different from that of the first via hole, a second via hole configured to penetrate through the first interlayer insulation film and the second interlayer insulation film, and reach the wiring layer; and forming a second electrical connecting member by filling the second via hole with a metal material and smoothing the surface of the second interlayer insulation film, wherein in formation of the electrothermal transducer, the electrothermal transducer is formed in a region on the surface of the second interlayer insulation film including the second electrical connecting member.

17. The method according to claim 16, wherein the first electrical connecting member is a first plug, and the second electrical connecting member is a second plug.

18. A printhead that uses an element substrate having a multilayered structure, uses an electrothermal transducer as a print element, and discharges ink by applying thermal energy to ink by the print element, comprising:

an orifice provided near the print element and configured to discharge ink;

a supply port configured to supply ink to the print element; and a pressure chamber configured to communicate with the supply port and the orifice, in which ink bubbles due to heat generation of the print element, wherein the element substrate comprises:

a base;

a wiring layer formed on a side of a front surface of the base;

a first interlayer insulation film configured to cover the wiring layer;

a temperature detection element formed on a surface of the first interlayer insulation film;

a first electrical connecting member configured to penetrate through the first interlayer insulation film, and electrically connect the temperature detection element and a wiring for the temperature detection element of the wiring layer;

a second interlayer insulation film formed on a surface of the temperature detection element and the surface of the first interlayer insulation film;

an electrothermal transducer arranged at a position where at least a part of the electrothermal transducer overlaps the temperature detection element when viewed from a direction perpendicular to the front surface of the base, and formed on a surface of the second interlayer insulation film; and a second electrical connecting member configured to penetrate through at least the second interlayer insulation film, and electrically connect the electrothermal transducer and a wiring for the electrothermal transducer of the wiring layer.

19. The printhead according to claim 18, wherein the printhead is a line head where a plurality of the element substrates are arranged.

20. A printing apparatus which prints an image by discharging ink to a print medium by using a printhead that uses an element substrate having a multilayered structure, uses an electrothermal transducer as a print element, and discharges ink by applying thermal energy to ink by the print element, wherein the printhead comprises:

an orifice provided near the print element and configured to discharge ink;

a supply port configured to supply ink to the print element; and a pressure chamber configured to communicate with the supply port and the orifice, in which ink bubbles due to heat generation of the print element, wherein the element substrate comprises:

base;

a wiring layer formed on a side of a front surface of the base;

a first interlayer insulation film configured to cover the wiring layer;

a temperature detection element formed on a surface of the first interlayer insulation film;

a first electrical connecting member configured to penetrate through the first interlayer insulation film, and electrically connect the temperature detection element and a wiring for the temperature detection element of the wiring layer;

a second interlayer insulation film formed on a surface of the temperature detection element and the surface of the first interlayer insulation film;

an electrothermal transducer arranged at a position where at least a part of the electrothermal transducer overlaps the temperature detection element when viewed from a direction perpendicular to the front surface of the base, and formed on a surface of the second interlayer insulation film; and a second electrical connecting member configured to penetrate through at least the second interlayer insulation film, and electrically connect the electrothermal transducer and a wiring for the electrothermal transducer of the wiring layer.

21. An element substrate having a multilayered structure comprising:

a base;

a wiring layer formed on a side of a front surface of the base;

a first interlayer insulation film configured to cover the wiring layer;

a temperature detection element formed on a surface of the first interlayer insulation film;

a first electrical connecting member configured to penetrate through the first interlayer insulation film, and electrically connect the temperature detection element and a wiring for the temperature detection element of the wiring layer;

a second interlayer insulation film which is formed on a surface of the temperature detection element and the surface of the first interlayer insulation film, and is thinner than the first interlayer insulation film;

an electrothermal transducer formed on a surface of the second interlayer insulation film; and a second electrical connecting member configured to penetrate through at least the second interlayer insulation film, and electrically connect the electrothermal transducer and a wiring for the electrothermal transducer of the wiring layer.

22. The element substrate according to claim 21, wherein the first electrical connecting member is a first plug, and the second electrical connecting member is a second plug configured to penetrate through the first interlayer insulation film and the second interlayer insulation film.

23. The element substrate according to claim 21, wherein a thickness of a portion of the second interlayer insulation film located on the temperature detection element falls within a range of 0.2 μm (inclusive) to 0.5 μm (inclusive).

* * * * *